United States Patent [19]

Andrews

[11] Patent Number: 4,625,974

[45] Date of Patent: Dec. 2, 1986

[54] OUTDOOR GAME CABINET

[76] Inventor: Frank Andrews, 536 Forest Blvd., Sheboygan Falls, Wis. 53085

[21] Appl. No.: 687,833

[22] Filed: Dec. 31, 1984

[51] Int. Cl.[4] ..... F41J 1/10; A63B 69/36

[52] U.S. Cl. ..... 273/407; 273/404; 273/181 R

[58] Field of Search ..... 273/403, 404, 407, 408, 273/26 A, 401, 402, 181 R, 181 A, 181 F; 206/579, 315.1; 248/441.1, 163.1, 530, 167; 217/7, 11

[56] References Cited

U.S. PATENT DOCUMENTS

| | | | |
|---|---|---|---|
| 215,633 | 5/1879 | Wright et al. | 273/407 |
| 3,300,216 | 9/1964 | Haecker | 273/403 |
| 3,501,149 | 11/1967 | Meyer | 273/407 |
| 3,675,922 | 7/1972 | Nieland | 273/550 |

FOREIGN PATENT DOCUMENTS

| | | | |
|---|---|---|---|
| 2358337 | 11/1973 | Fed. Rep. of Germany | 273/407 |

*Primary Examiner*—Richard C. Pinkham
*Assistant Examiner*—Gary Jackson
*Attorney, Agent, or Firm*—Donald Cayen

[57] ABSTRACT

A portable game cabinet is especially useful for shooting darts out of doors. The cabinet includes a target carrying case supported by adjustable and telescoping legs which permit the player to set up the target board on uneven surfaces. The legs are removeable from the case and are conveniently stored therein. The case is constructed so as to hold playing equipment in addition to the target board, and the case is closeable by doors to enclose the playing equipment and target board. The cabinet includes convenient means for setting a shooting line without the player having to make any measurements. The target board is adjustable between two playing heights by completely telescoping or extending one section of each leg. A safety net is raised above the cabinet to catch darts which miss the target by a wide margin.

8 Claims, 7 Drawing Figures

OUTDOOR GAME CABINET

BACKGROUND OF THE INVENTION

1. Field of the Invention

This invention pertains to game apparatus, and more particularly to portable target games suitable for outdoor use.

2. Description of the Prior Art

The sport of shooting darts is well known, and it is becoming increasingly popular. To suit different ranges of interests and skill among dart shooters, various types of dart game equipment have been developed, including steel and soft tipped darts, steel and plastic target boards, and automatic electronic scoring machines.

It is a characteristic of prior dart game equipment that the equipment limits the sport to be enjoyed almost exclusively indoors. Although the darts themselves are suitable for both indoor and outdoor use, the target boards are not designed for easy transportation and setup at random outdoor locations. If a player desires to shoot darts outdoors, he must locate a suitable solid vertical surface, as, for example, the side of a building, to which he temporarily or permanently fixes the target board. While possible, it is nevertheless inconvenient to hang the target board from a tree limb or attach the target board to a tree trunk. Consequently, outdoor locations at which the sport may be enjoyed have been limited to the availability of suitable mounting surfaces.

Thus, a need exists for portable dart game equipment which may be conveniently set up at any desired outdoor location.

SUMMARY OF THE INVENTION

In accordance with the present invention, an outdoor game cabinet is provided which may be set up for playing in convenient and random outdoor as well as indoor locations. This is accomplished by apparatus which includes a set of telescoping legs adapted both to support a target mounted in a carrying case and to be stored within the case.

The case is formed with a pair of sockets for fixedly receiving two of the telescoping legs and a pin and notch arrangement for pivotally receiving a third leg. The case further includes a pair of doors for enclosing the case during transportation thereof and for exposing a target board attached within the case while a game is being played. The case is suitable for removeably mounting steel or plastic target boards. Other structural features of the case include means for holding the telescoped legs and for holding darts and related equipment inside the case during transportation. A handle on the case enhances portability.

The three leg design permits the game cabinet of the present invention to be set up in a stable condition on outdoor surfaces which are not level. Further, the three legs may be independently adjusted to obtain a vertical target surface. To determine the proper adjustment, the case may include a bubble level.

The telescoping legs are designed so that when they are fully extended the center of the target is at the official dart shooting height of five feet eight inches above ground level. The legs are further designed so that upon the collapsing of a selected section of each leg, the target center is at a second specified height of four feet above the ground. The end of each leg terminates in a point suitable for penetrating the ground and a flange for preventing excess penetration. To enable the present invention to be used on concrete or other hard surfaces, both indoors and outdoors, rubber or plastic caps are included for covering the points. The invention further includes a safety net designed to catch errant darts or other projectiles thrown at the target board. The net is supported from the case during play, and it is storeable inside the case with the other game equipment for transportation and storage.

Further in accordance with the present invention, the outdoor game cabinet includes a shooting line which may be set quickly and conveniently without requiring any measurements of the distance between the shooting line and the target board. In a preferred embodiment, the shooting line is set by a pair of flexible cords of predetermined length, each of which is attached to a fixed leg and to one end of a marker. Extending the cords to their full lengths automatically sets the marker at the specified distance from the target board.

Other aims and advantages of the invention will become apparent to those skilled in the art from the detailed description.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
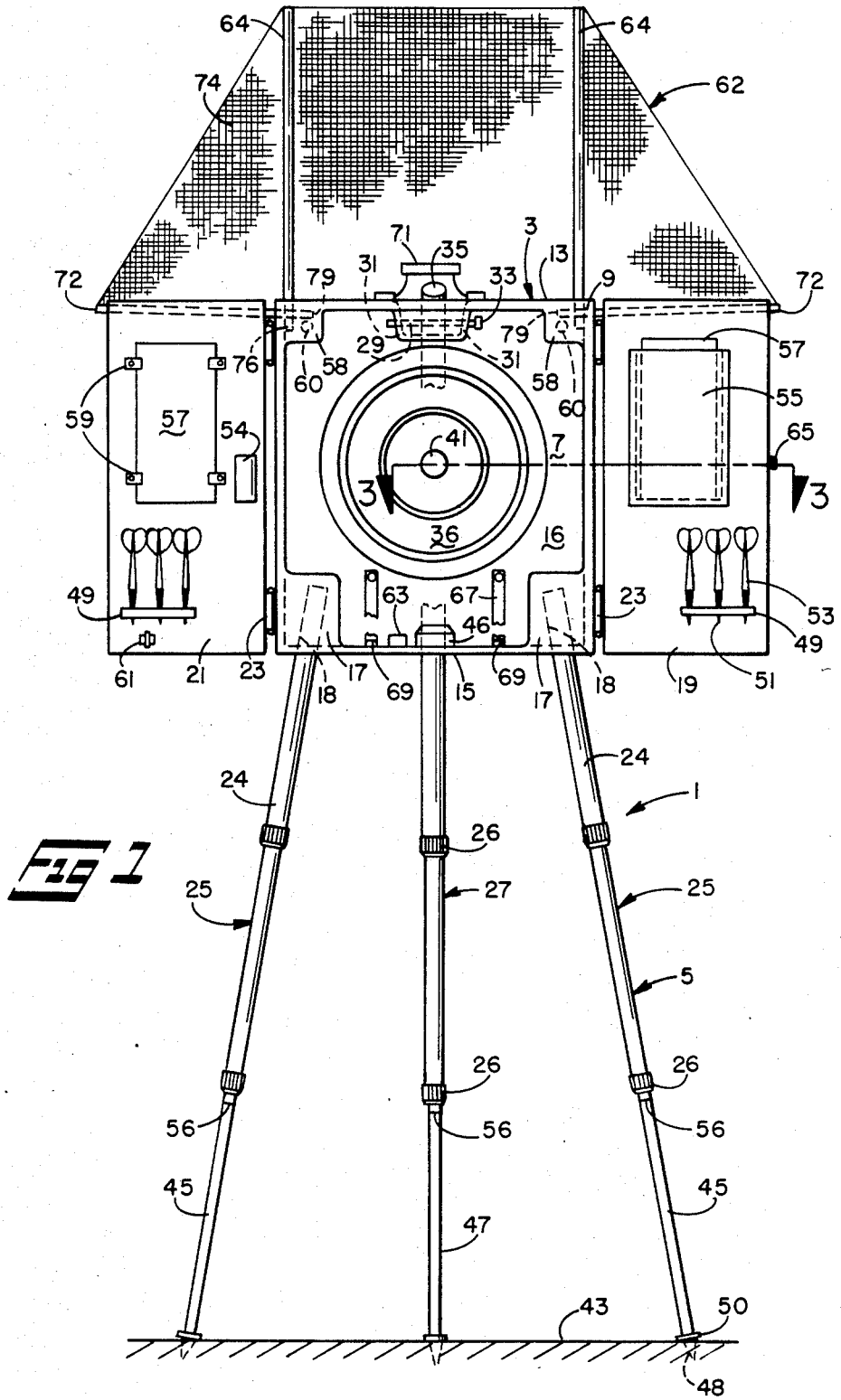
FIG. 1 is a front view of the outdoor game cabinet of the present invention shown in the assembled configuration suitable for playing a target game.
Figure 2:
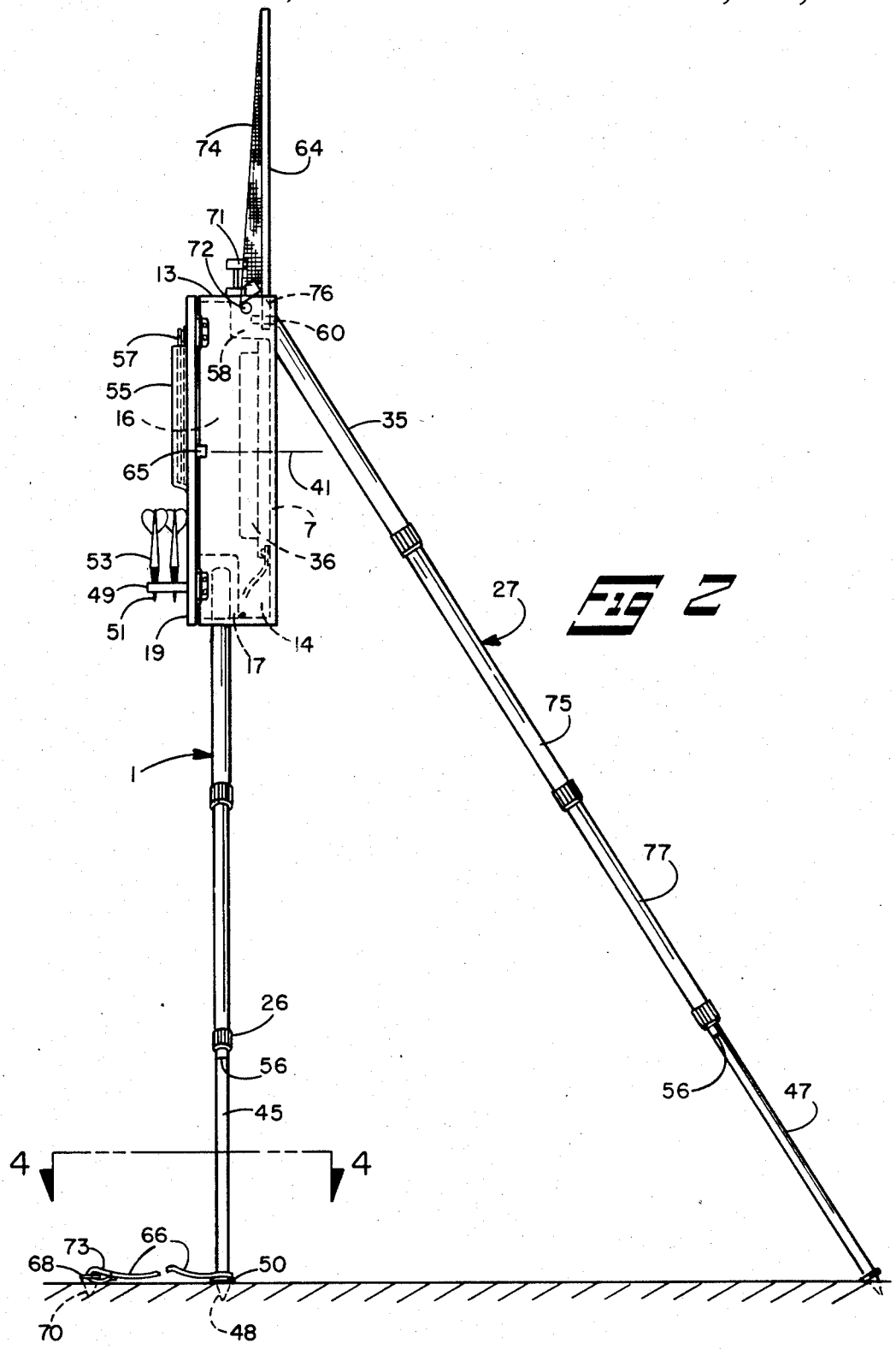
FIG. 2 is a side view of the outdoor game cabinet shown in the assembled configuration.

Referring to FIGS. 1 and 2, an outdoor game cabinet 1 is illustrated which includes the present invention. The outdoor game cabinet finds particular usefulness when employed in conjunction with dart games, but it will be understood that the invention is not limited to target shooting applications.

The outdoor game cabinet 1 includes a case 3 supported by a plurality of independently adjustable and removeable legs 5. The case 3 is preferably manufactured from a strong but light moldable material. Polyvinyl chloride plastic is especially suitable for a case material. The case comprises a back wall 7, side walls 9 and 11, top wall 13, and bottom wall 15, which together define a case cavity 16. The dimensions of the case may be approximately 26 inches square by 6 inches deep.

Molded as integral parts of the case 3 are a pair of thick support sections 17 which are spaced from the back wall 7, thereby creating a pair of spaces 14 therebetween. Each support section 17 contains a cylindrical socket 18 which opens through the bottom wall 15. The cylindrical sockets 18 preferably have downwardly diverging longitudinal axes.

The case cavity 16 is closeable by at least one and preferably a pair of doors 19 and 21 which are mounted on conventional hinges to the side walls 9 and 11, respectively. The doors 19 and 21 may be made of the same moldable material as the case 3.

Inserted into each socket 18 is the top section 24 of a front telescoping leg 25. In the illustrated construction, the front legs 25 are composed of three interfitting tubes which are lockable together by adjustment nuts 26, as is known in the art. Rear telescoping leg 27 is substantially longer then the front legs, because rear leg 27 extends downwardly from the case 3 at an angle relative to the vertical front legs. To provide protuberance free outside surfaces for the case, the case is formed with an angular notch 29 at the midpoint of the junction of the back wall 7 with the top wall 13. The notch 29 is partially bounded by vertical generally triangular shaped walls 31. A pin 33 extends horizontally through the walls 31 and through an aligned aperture in the top section 35 of the rear leg. Thus, the rear leg is pivotable relative to the case.

Figure 3:
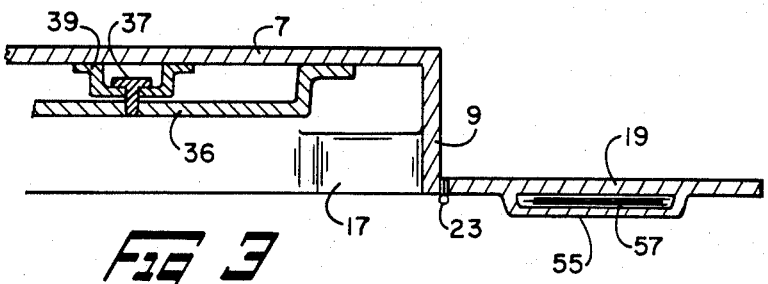
FIG. 3 is an enlarged sectional view taken along lines 3—3 of FIG. 1.

When the outdoor game cabinet 1 of the present invention is used in conjunction with a dart game, the dart target board 36 is mounted to the inside surface of the back wall 7. The target board 36 may be of steel or plastic construction, as is well known. Target board mounting may be by any suitable means, as, for example, by a headed pin 37 secured to the target board and vertically slideably received in a slotted bracket 39. See FIG. 3. The bracket 39 may be molded integrally with the back wall 7, or it may be a separate piece secured permanently to the back wall.

The official height of the center 41 of a dart target board 36 above the ground level 43 is five feet eight inches. Accordingly, the legs 25 and 27 are preferably constructed so that when the respective telescoping sections of the legs are fully extended and the rear leg 27 is approximately 30 degrees to vertical, the target center 41 is at the requisite height. Since dart shooting is a popular sport with children as young as five to eight years, it is a desirable feature of the present invention that the target board may be easily set up at a recommended lower height above ground level. The primary purpose of the lower height is to reduce the possibility of a dart slipping from a child's fingers and falling and striking him in the face if he reaches above his head to normal target height when removing darts from the board. An unofficial lower height of center 41 of four feet above ground level 43 has been established as satisfactory. To easily and quickly permit height adjustment between the two usual heights, the lower sections 45 and 47 of the front and rear legs 25 and 27, respectively, are dimensioned so that when the lower sections are fully collapsed within the respective adjacent sections, and the other sections remain fully extended, the desired lower target height of four feet is obtained.

Figure 6:
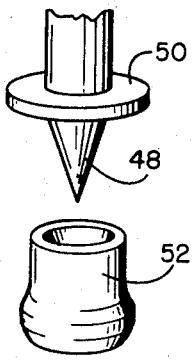
FIG. 6 is an enlarged exploded perspective view of the lower end of a telescoping leg included in the present invention.

With either height, the pivotability of the rear leg 27 permits the outdoor game cabinet 1 to be set up on uneven ground. Further, if necessary, one of the front legs 25 may also be adjusted to suit the ground contour. The pivoting and telescoping nature of the rear leg further permits adjustment thereof to insure that the target board 36 is set up in a vertical attitude. To facilitate determining the proper attitude, a bubble level 46 may be secured to the case 3, as, for example, to the inside of the bottom wall 15, FIG. 1. To assist firmly planting the legs in the ground 43, the lower end of each section 45 and 47 terminates in a point 48. A flange 50 prevents excessive insertion of the legs into the soil; the official height of center 41 is obtained when the flanges 50 are in contact with the surface of the soil. To permit the game cabinet 1 to be set up on concrete or other hard outdoor surfaces, a resilient rubber or plastic cup 52 is slipped over each leg point 48 stretched over the flange 50. See FIG. 6. The cups 52 also permit using the game cabinet on easily damaged indoor floors.

When the game cabinet is set up on a hard surface with the cups 52 in place, the height of center 41 is greater than the official height of five feet eight inches. To permit easy and rapid adjustment of the target board 36 to the correct height, a scribe line 56 is etched on the lower sections 45 and 47, FIGS. 1 and 2. The scribe lines are located below the nuts 26 at a distance equal to the height of a point 48 plus the thickness of the bottom wall of a cup. Thus, partially collapsing the lower sections 45 and 47 into the respective adjacent leg sections results in the correct height for the target board without requiring any measurements. Since the target board center height of four feet is unofficial, the small deviation from that height occurring with the cups on a hard surface and the lower sections fully collapsed is not important.

To further increase the versatility of the present invention, the case 3 may be suspended from a vertical wall, either indoors or outdoors, without utilizing the legs 5. For that purpose, the case is manufactured with a boss 58 at the interior junction of the top wall 13 with each side wall 9 and 11. Each boss 58 defines a blind hole 60 opening from the back wall 7. Preferably, the holes 60 slope downwardly toward the back. A pair of nails of similar supports may be mounted to a vertical wall for registering with the holes 60 to suspend the cabinet on the wall.

To increase the safety of persons, pets, and objects in the vicinity of the set up outdoor game cabinet 1, the present invention includes a safety net 62. In the illustrated construction, the safety net 62 lies in a substantially vertical plane and is composed of a pair of upstanding poles 64, a pair of laterally extending poles 72, and a net 74 fastened to and stretched between the poles. The poles 64 are held in place in case 3 by vertical sockets 76 defined by bosses 58 and opening from the top wall 13. Poles 72 are held in place by horizontal sockets 79 opening from the side walls 9 and 11. It is desirable that the poles 72 slope slightly upwardly toward the free ends thereof. The net 74 is fastened to the poles by any suitable means, such as rivets. The net is constructed with a generally rectangular portion above the case and a generally triangular shaped portion above each door 19 and 21. It is preferred that the safety net 62 extend approximately 20 inches above the top wall 13 and approximately 15 inches from the side walls 9 and 11. The material for the poles may be metal or plastic. The net is preferably a nylon or other strong synthetic material. The mesh of the net is sufficiently fine so that a dart striking the net will be captured thereby. The safety net is particularly desirable when the game cabinet is used by young players.

To provide greater convenience to the users of the outdoor game cabinet 1, one or both doors 19 and 21 may include a rack 49 fixed to the inside surface thereof.

The racks 49 have holes extending vertically therethrough for receiving the tips 51 of darts 53, thereby forming convenient storage receptacles for the darts. The inside surface of a door may be molded with an open top pocket 55 for storing scoring sheets 57 and instructions. Alternatively, a pocket may be created from a separate piece of material fastened along the bottom and side edges thereof to a door. The other door may be provided with spring clips 59 for releasably holding a scoring sheet 57 for marking during play. A pouch 54 for storing the cups may be fastened to a door by any suitable means. One door preferably includes a conventional spring loaded latch 61 for cooperating with plate 63 mounted to the case bottom wall 15 to secure the door in the closed position. Mounted to the outside of the doors is a conventional lock 65 for preventing unintended access to the closed case 3.

Figure 4:
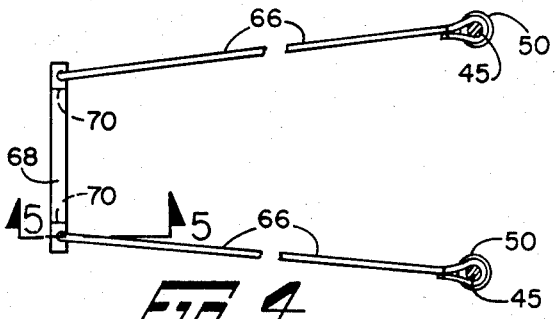
FIG. 4 is a sectional view taken along lines 4—4 of FIG. 2.
Figure 5:
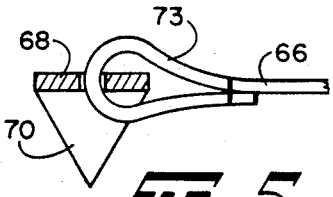
FIG. 5 is an enlarged sectional view taken along lines 5—5 of FIG. 4.

To increase user convenience, the outdoor game cabinet 1 includes means for setting a shooting line behind which a player must stand when shooting his darts 53. Referring to FIGS. 2, 4, and 5, the line setting means includes a pair of equal length flexible cords 66, each of which is suitably connected at one end thereof to a front leg end section 45. In the construction illustrated, the cords 66 are swivelably looped around the sections 45 above the flanges 50. The second end of each cord is connected, as by a loop 73, to opposite ends of an elongated marker 68. One surface of the marker 68 is formed with a pair of projections 70 suitable for penetrating the ground 43. The marker may be of plastic or metal construction. The length of the cords is such that the horizontal distance from the target board 36 to the marker 68 is the correct shooting distance, which, in the case of darts, is eight feet.

Figure 7:
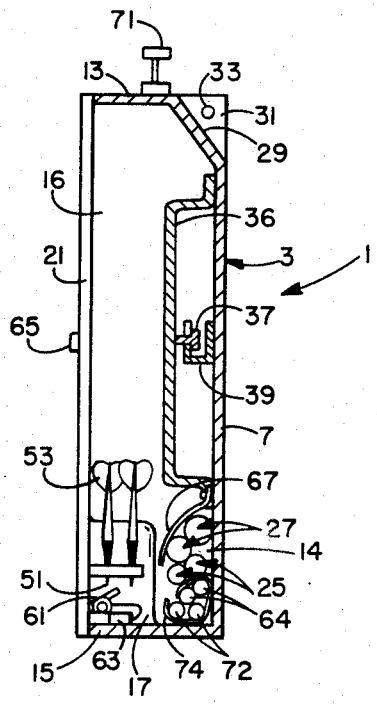
FIG. 7 is an enlarged vertical sectional view of the outdoor game cabinet shown in the completely disassembled configuration suitable for convenient transportation and storage.

Turning to FIG. 7, the outdoor game cabinet 1 is shown in the disassembled configuration for transporting or storing. The front legs 25 are convertible from the assembled condition of FIGS. 1 and 2. The legs are removed from the sockets 18, completely collapsed, and nested in the storage spaces 14 between the back wall 7 and support sections 17. The cords 66 and marker 68 are wrapped around the front legs. Pin 33 is removed to permit rear leg 27 to be removed from the notch 29. The rear leg may be separated into two parts, with sections 35 and 75 constituting one part and sections 47 and 77 constituting the second part. See FIG. 2. The collapsed sections of the rear leg are stored adjacent the legs 25. The poles 64 and 72, with the net 74 wrapped around them, are also stored in the space 14. A pair of straps 67, each having one end permanently secured to the back wall and the second end removeably secured, as by snaps 69, to the bottom wall 15, are employed to hold the stored legs and safety net 62 in place. See FIG. 1. A convenient collapsible handle 71 enhances portability of the outdoor game cabinet.

To use the outdoor game cabinet 1 of the present invention, it is carried to any desired location, either outdoors or indoors. The lock 65 and latch 61 are unfastened and the doors 19 and 21 are opened. Straps 67 are unsnapped, and the legs 25 and 27 are removed from the case 3. The cords 66 and marker 68 are unwrapped from the front legs. The legs 25 and 27 are completely extended if the target board 36 is to be set up at the official height on soft ground. The lower sections 45 and 47 are partially inserted into the respective adjacent leg sections until scribe lines 56 coincide with the lower edges of nuts 26 if the game cabinet is to be set up with the cups 52 on a hard surface. The top section 24 of each front leg is inserted into a socket 18. Pin 33 is inserted through the apertures in the triangular walls 31 and rear leg top section 35. The rear leg is pivoted about the pin 33 until the bubble level 46 indicates the target board 36 lies in a vertical plane. If necessary, either front leg may also be adjusted. Points 48 may be pushed into the ground 43 to the level of flanges 50. The lower sections 45 and 47 are completely inserted into the adjacent sections if the target board is to be set up at the four foot height. For both heights, the cords 66 are stretched tight, and the marker projections 70 may be pushed into the ground to create the shooting line. The safety net 62 is removed from the space 14 and unrolled. The poles 62 and 74 are inserted into their respective sockets 76 and 79, thereby raising the safety net for safe play.

Thus, it is apparent that there has been provided, in accordance with the invention, an outdoor game cabinet which fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An outdoor game cabinet for storing and transporting selected game components including a target board comprising:

a. case means for holding the game components;

b. door means for selectively enclosing the components within the case means and for exposing the target board; and c. leg means convertible between an extended assembled condition for supporting the case means at a predetermined height above the ground and a collapsed disassembled condition for nesting within the case means for storage therein, the leg means being adjustable to permit proper alignment of the target board on uneven ground surfaces when in the extended assembled condition, the leg means comprising at least three legs, each leg having an upper end for securing to the case means and being adapted to telescope between a fully expanded condition and a fully collapsed condition, wherein at least one leg is pivotally connected at the upper end thereof to the case means at the junction of a back wall and a top wall of the case means, wherein a portion of the case means back and top walls is formed with an angular notch bounded by a pair of spaced vertical walls, and wherein a pin extends horizontally through the spaced walls and through the upper end of the pivotal leg, so that the pivotable leg is pivotally received within the case means notch.

2. An outdoor game cabinet for storing and transporting selected game components including a target board comprising:

a. case means for holding the game components;

b. door means for selectively enclosing the components within the case means and for exposing the target board; and c. leg means convertible between an extended assembled condition for supporting the case means at a predetermined height above the ground and a collapsed disassembled condition for nesting within the case means for storage therein, the leg means being adjustable to permit proper alignment of the target board on uneven ground surfaces when in the extended assembled condition; and d. safety net means for catching errant game components thrown at the target board, wherein the safety net means comprises;

i. a pair of poles upstandingly and removeably received in the case means;

ii. a pair of poles removeably received in and extending laterally in opposite directions from the case means; and iii. a net fastened to and stretched between the upstanding and lateral poles, the net being adapted to capture errant game components thrown at the target board.

3. A portable outdoor game cabinet comprising:

a. a case having side, top, back, and bottom walls defining a case cavity, the case including at least two sockets opening from the bottom wall for removeably receiving a leg therein, the legs being nonpivotable with respect to the case when received within the sockets;

b. a target board within the case cavity and secured to the back wall;

c. door means for selectively enclosing or opening the case cavity to expose the target board; and d. at least three legs removeably secured to the case, the legs being telescoping and adjustable to support the target board in a desired attitude and at a predetermined distance above the ground, the legs being adapted to be storable within the case cavity when not supporting the case, and wherein:

i. there is one pivotable leg defining an apperture therethrough near one end thereof;

ii. the case defines an angular notch partially bounded by two vertical triangular walls formed at the junction of the top and back walls and adapted to receive the pivotable leg; and iii. a pin extends through the triangular walls and through the apperture in the pivotable leg, so that the pivotable leg pivots about the pin within the triangular notch to permit adjustment of the attitude of the target board.

4. The outdoor game cabinet of claim 3 wherein the door means includes rack means attached to the door means for removeably storing game components that are used for throwing at the target board.

5. The outdoor game cabinet of claim 3 wherein the case is formed with a pair of support sections, each support section defining a socket for removeably receiving an adjustable leg, the longitudinal axes of the sockets diverging downwardly, and wherein the outdoor game cabinet further comprises means for setting a shooting line at a predetermined distance from the target board, the means for setting the shooting line comprising:

a. an elongated marker; and b. a pair of flexible cords of equal and predetermined lengths, each cord having a first end fastened to a fixed leg and a second end fastened to the marker, so that when the cords are extended from the legs the marker is at the proper shooting distance from the target.

6. The outdoor game cabinet of claim 3 wherein the case is formed with a pair of support sections, each support section defining a socket for removeably receiving an adjustable leg, the longitudinal axes of the sockets diverging downwardly, and wherein the outdoor game cabinet further comprises:

a. at least one upstanding pole removeably received within the case;

b. at least two poles extending laterally in opposite directions from the case; and c. a net fastened to and stretched between the poles, the net being adapted to catch errant game components thrown at the target board.

7. The outdoor game cabinet of claim 6 wherein:

a. the case top wall defines at least two substantially vertical sockets for removeably receiving the upstanding poles; and b. each case side wall defines a generally horizontal socket for removeably receiving the laterally extending poles.

8. The outdoor game cabinet of claim 6 wherein the support sections are spaced from the case back wall to create a storage space therebetween, so that the legs may be collapsed and the safety net may be stored between the back wall and support sections.

* * * * *